US006830517B1

(12) United States Patent
Ciraolo

(10) Patent No.: US 6,830,517 B1
(45) Date of Patent: Dec. 14, 2004

(54) ROTATING ATTACHMENT DEVICE FOR A SWING

(76) Inventor: Charles Ciraolo, 9327 Wheatlands Rd., Santee, CA (US) 92071

( * ) Notice: Subject to any disclaimer, the term of this patent is extended or adjusted under 35 U.S.C. 154(b) by 0 days.

(21) Appl. No.: 10/857,717

(22) Filed: May 28, 2004

(51) Int. Cl.[7] ..... A63G 0/12
(52) U.S. Cl. ..... 472/118; 403/313; 384/295
(58) Field of Search ..... 472/118–125; 384/434–437, 295; 403/313, 305, 309, 310, 312.3

(56) References Cited

U.S. PATENT DOCUMENTS

| | | | | |
|---|---|---|---|---|
| 492,047 A | * | 2/1893 | Otis et al. | 138/99 |
| 1,343,463 A | * | 6/1920 | Davies | 138/99 |
| 2,791,019 A | * | 5/1957 | Du Laney | 249/124 |
| 3,014,683 A | | 12/1961 | Littmann | |
| 4,138,104 A | | 2/1979 | D'Amicis | |
| 4,852,913 A | | 8/1989 | Brooks | |
| 5,013,166 A | * | 5/1991 | Domer | 384/220 |
| 5,147,247 A | | 9/1992 | Addleman | |
| 5,529,539 A | | 6/1996 | Hoffman | |
| 6,123,480 A | | 9/2000 | Petty et al. | |
| 6,669,394 B1 | | 12/2003 | Rieber et al. | |

* cited by examiner

*Primary Examiner*—K. T Nguyen
(74) *Attorney, Agent, or Firm*—Calif Tervo

(57) ABSTRACT

A rotating attachment device for attaching the upper end of a swing to a support bar generally comprises and inner bearing and an outer bearing. The inner bearing comprises at least two inner bearing arc segment members for direct placement on the cross bar, each including an outer side including a raceway including a radial bearing surface. The outer bearing includes a first and second semi-cylindrical outer bearing members including an inner side having a bearing surface, pivotly connected first ends such that the outer bearing is pivotable between an open position for fitting over the first bearing and a closed position bearing on the inner bearing such that the outer bearing is rotatable 360 degrees about the swing support bar, and second ends including a latch for latching the outer bearing around the inner bearing in the closed position.

16 Claims, 2 Drawing Sheets

ROTATING ATTACHMENT DEVICE FOR A SWING

FIELD OF THE INVENTION

This invention relates in general to a device for attaching a swing to a cross bar of a swing set such that the swing may rotate 360 degrees about the cross bar and more specifically to such a device that may be attached easily and directly in position.

BACKGROUND OF THE INVENTION

Children's swings, glide rides, and the like usually are incorporated in a swing set including some kind of a seating platform suspended by suspension means, such as chains, cables, tubes or the like, from a cross bar or other raised horizontal support.

One problem with playground swing sets is that children often throw the swings over the upper crossbar of the swing set so that the swings may ultimately become wrapped around the crossbar. Wrapped swings are typically unusable and must be unwrapped by maintenance personnel. A swing that is wrapped around the cross bar only once, and evenly, may appear to be usable; however its use may damage the crossbar or the chains that support the swing seat, or could prove dangerous to the user. Unwrapping swings consumes the time of maintenance personnel and is thus expensive. It is thus desirable to provide a device that prevents the swings from being wrapped over the cross bar.

Several rotating attachment devices for a swing have been proposed. These devices have one or more shortcomings. First, some are difficult to install in that they are installed over the end of the cross arm. Thus, they must be installed upon initial assembly of the swing set or, if installed in the field as repair, the cross bar must be disassembled from the remainder of the swing set and any attachment devices between the end of the cross bar and the place of replacement must be removed and later reattached. Therefore, it is desirable to have a swing attachment device that may easily be attached to a cross bar in situ without disassembly of other components.

Another shortcoming of some rotating attachment devices is that they contain bearings that wear and must be replaced. Therefore, it is desirable to have a rotating attachment device wherein the bearings are easily replaced.

There do exist bearing assemblies for swing sets that do allow a chain or other suspension means to pivot completely over the top bar and that are attachable in situ, for example; U.S. Pat. No. 3,531,077 to Trottier et al. However, such assemblies are relatively complicated devices consisting of several separate parts that must be assembled using a multiplicity of small fasteners. Considering the fact that most present day swing sets are sold in a knock-down condition for assembly by the ultimate purchaser, it is not surprising that those small parts are often misplaced or lost entirely. At the very least, the required installation of all those parts prolongs the time it takes to assemble or repair the swing set.

SUMMARY OF THE INVENTION

This invention is a rotating attachment device for attaching the upper end of a swing to a swing support bar, such as a cross bar, and it generally comprises an inner bearing and an outer bearing. The inner bearing comprises at least two inner bearing arc segment members for direct placement on the cross bar. Each inner bearing arc segment member includes an inner side adapted for engaging the outer surface of the bar and an outer side, including a raceway including a radial bearing surface and a radial flange on each side of the radial bearing surface. The radial bearing surfaces form arc segments defining an outward facing cylindrical bearing surface when the inner bearing members are attached, such as with screws, to the cross bar.

The outer bearing includes a plurality of outer bearing members, such as a first outer bearing member and a second outer bearing member including an inner side including a bearing surface adapted for bearing on the radial bearing surfaces, pivotly connected first ends, such that the outer bearing is pivotable between an open position for fitting over the cylindrical bearing surface and a closed position wherein the inner side bearing surfaces are arc segments defining an inward facing cylindrical bearing surface for bearing on the outward facing bearing surface such that the outer bearing is rotatable 360 degrees about the swing support bar, and second ends including latching means for latching the outer bearing around the inner bearing in the closed position.

The outer bearing includes attaching means, such as a shackle, for pivotly attaching and supporting the upper end of the swing suspension member.

Other features and many attendant advantages of the invention will become more apparent upon a reading of the following detailed description together with the drawings wherein like reference numerals refer to like parts throughout.

DETAILED DESCRIPTION OF THE INVENTION

Figures 1, 2, 3:
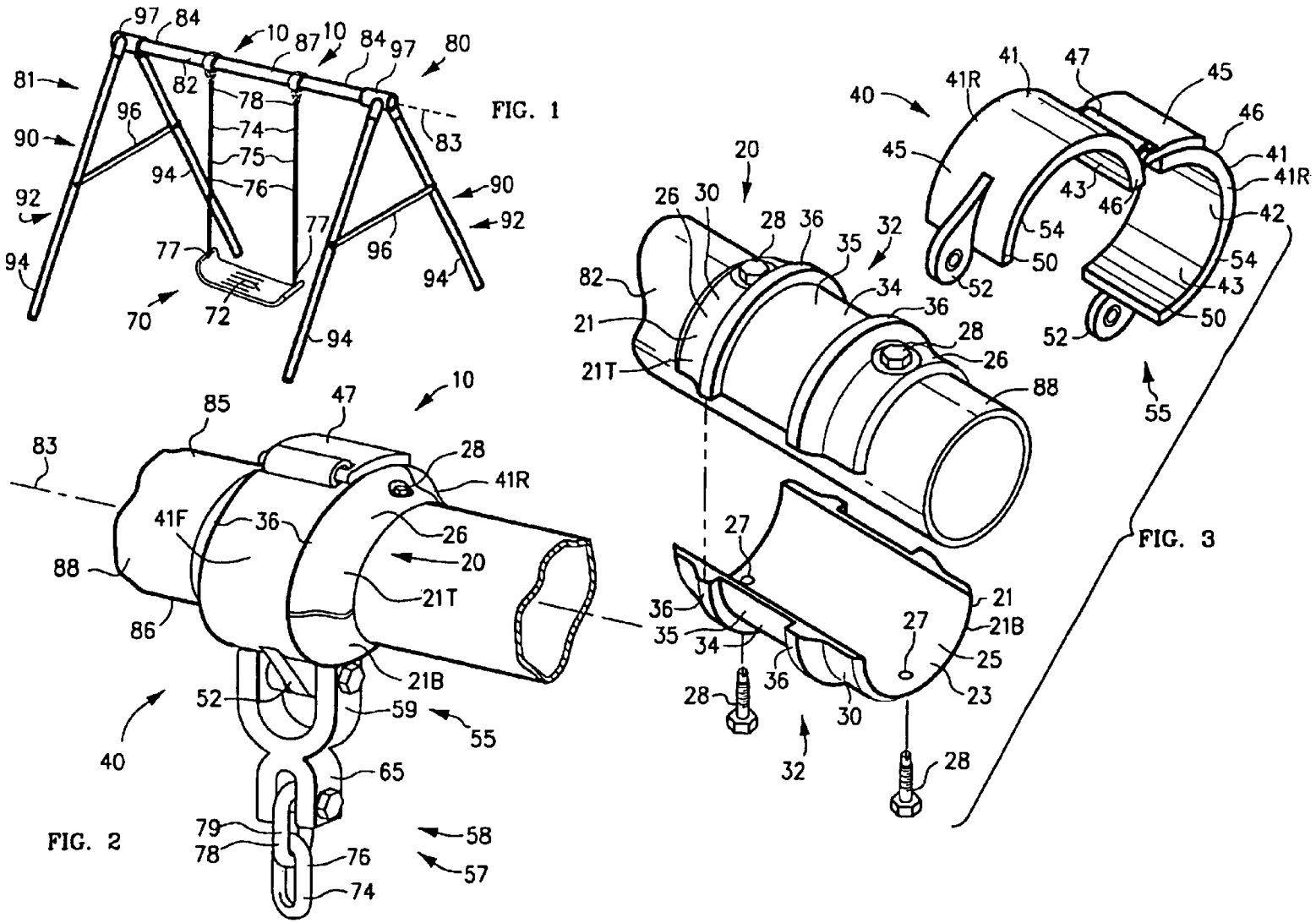
FIG. 1 is a perspective view of a swing set including a pair of rotating attachment devices of the invention.
FIG. 2 is an enlarged perspective view of the device of FIG. 1.
FIG. 3 is an enlarged exploded view of the device showing the method of attachment to the swing set cross bar.

With reference now to the drawings, FIG. 1 is a perspective view of a swing set 80 including a pair of rotating attachment devices 10 of the invention. FIG. 2 is an enlarged perspective view of the device 10 of FIG. 1. Swing set 80 generally includes a swing 70 and a frame 81. Swing 70 includes a platform, such as seat 72, and a pair of suspension members 74 for suspending seat 72 from frame 81. Suspension member 74 may be a rigid bar or rod, but is typically a flexible tension member 75, such as rope or chain 76, including a bottom end 77 for attachment to seat 72 and a top end 78 for attachment to device 10. Although a pair of suspension members 74 are shown and described, device 10 may be used with a swing 70 having a single suspension member 74. Frame 81 generally includes a swing support bar, such as ridge pole, top bar or cross bar 82, and a support 90 for supporting cross bar 82 at an elevated position such that swing 70 can be suspended therefrom. Cross bar 82 has a longitudinal axis 83, ends 84, a top 85, a bottom 86, an outer surface 88 and mid section including a swing support section 87. Support 90 includes a pair of A-frames 92, each including a pair of angled legs 94 with a stabilizing bar 96 therebetween. Legs 94 have an upper terminus at a socket 97 into which an end 84 of cross bar 82 is attached. Although a typical swing set 80 is shown and described many variations are possible which still fall within the scope of the invention. For example, if the bottom ends of legs 94 are fixed, such as embedded in a medium, such as concrete, then the stabilizing bar 96 is often omitted. For purposes of the invention, ends 84 of cross bar 82 may be permanently fixed, such as by welding, to support 90.

Figure 4:
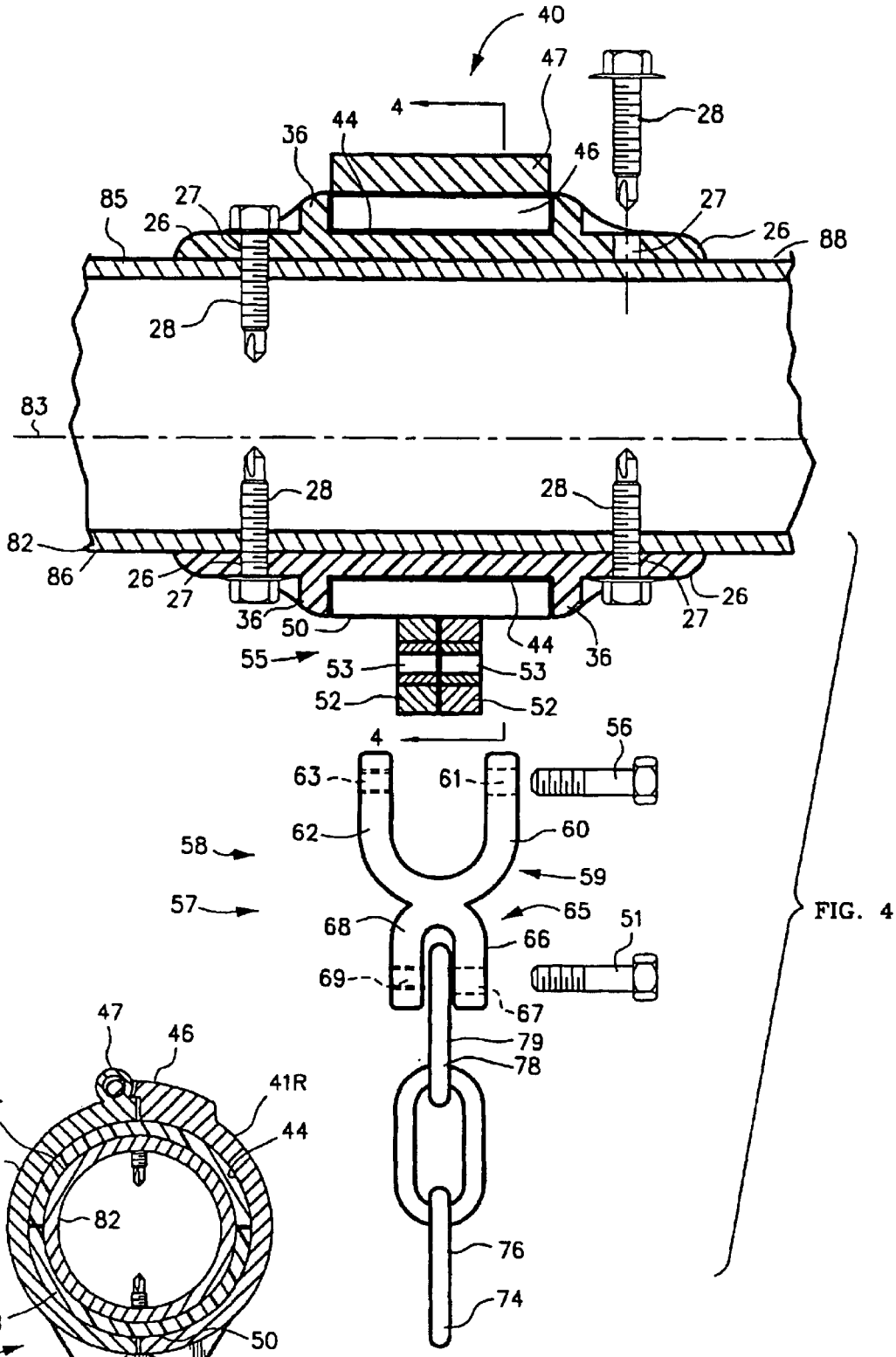
FIG. 4 is a partly exploded cross sectional view of the device attached to a cross bar and swing suspension member.
Figure 5:
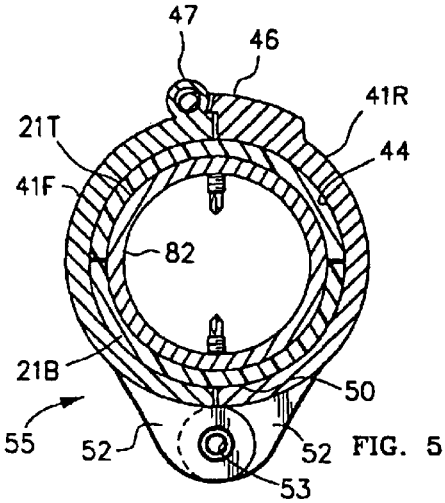
FIG. 5 is a sectional view of the device taken on line 4—4 of FIG. 4.

Further looking at FIGS. 3–5; FIG. 3 is an enlarged exploded view of device 10 showing the method of attachment to swing set cross bar 82, FIG. 4 is a partly exploded cross sectional view of device 10 attached to cross bar 82 and swing suspension member 74, and FIG. 5 is a sectional view of device 10 taken on line 4—4 of FIG. 4.

Rotating attachment device 10 generally comprises an inner bearing 20 and an outer bearing 40. Inner bearing 20 comprises at least two inner bearing arc segment members 21, such as first or top member 21T and second or bottom member 21B. Each inner bearing arc segment member 21T, 21B includes an inner side 23 and an outer side 30. Inner side 23 includes an inner surface 25 adapted for engaging outer surface 88 of cross bar 82. Outer side 30 includes a raceway 32 including an outward facing radial bearing surface 34, a pair of radial flanges 36 with one flange 36 located on each side of bearing surface 34, and a shoulder 26 outside of each flange 36. Radial bearing surfaces 34 are adapted to be arc segments defining an outward facing cylindrical bearing surface 35 when inner surfaces 25 are engaged with outer surface 88 of cross bar 82.

In the preferred embodiment shown, inner bearing members 21T, 21B include attachment means for attaching them to cross bar 82 such that they cannot move longitudinally. Attachment means includes bores 27 through inner bearing members 21T, 21B, such as through shoulder 26, and self tapping screws 28 for passage through bores 27 and into cross bar 82. Preferably, shoulder 26 slants radially inward from the top of flange 36 and includes a recess for containing the head of screw 28. In the preferred embodiment shown, cross bar 82 is a pipe having a circular cross section. Inner surfaces 25 of inner bearing members 21T, 21B are semi-cylindrical so as to abut and completely surround cross bar 82 when they are attached to cross bar 82. Preferably each inner bearing arc segment member 21 is less than 180 degrees of arc so as to be readily attached to cross bar 82. Inner bearing 20 may be made of any suitable material such as those well-known in the art such as self-lubricating nylon.

Outer bearing 40 generally comprises at least two outer bearing members 41, such as first outer bearing member, such as rear outer bearing member 41R and second outer bearing member, such as front outer bearing member 41F. Each outer bearing member 41F, 41R includes an inner side 42, an outer side 45, a first end, such as top end 46, a second end, such as bottom end 50, and side edges 54.

Inner side 42 includes a bearing surface 43 adapted for bearing on radial bearing surfaces 34 of raceway 32. Top ends 46 include cooperating pivot connector means, such as hinge 47, pivotly connecting top ends 46 such that front and rear members 41F, 41R are pivotable between an open position as shown in FIG. 3 for fitting over cylindrical bearing surfaces 35 and a closed position wherein inner side bearing surfaces 43 are arc segments defining an inward facing cylindrical bearing surface for bearing on outward facing cylindrical bearing surface 35 such that outer bearing is rotatable 360 degrees about inner bearing 20 and about cross bar 82. Bottom ends 50 include latching means 55 for latching outer bearing 40 around inner bearing 20 in the closed position. Latching means 55 includes circumferential projections 52, each including an aperture or eye 53. As best seen in FIG. 5, projections 52 overlap in the closed position such that eyes 53 align for receiving a fastener, such as bolt 56 for holding outer bearing 40 in the closed position.

Outer bearing members 41F, 41R each have a width less than the distance between radial flanges 36 such that radial flanges 36 restrain axial movement of outer bearing 40 relative to inner bearing 20. Preferably, outer bearing 40 is of much harder material, such as of iron or steel, than inner bearing, such that only inner bearing wears and needs replacement.

As best seen in FIGS. 2 and 4, attaching means 57 includes a shackle 58 for pivotly joining outer bearing 40 with connection loop 79 of chain 76. Shackle 58 includes an upper clevis 59 and a lower clevis 65. Upper clevis 59 includes first and second bores 61, 63 through first and second arms 60, 62 respectively, second bore 63 being threaded for receiving the threaded end of partially threaded bolt 56. Bolt 56 pivotly attaches upper clevis 59 to outer bearing 40, such as to latch eyes 53, and thereby retains outer bearing 40 on inner bearing 20.

Lower clevis 65 includes first and second bores 67, 69 through first and second arms 66, 68 respectively, second bore 69 being threaded for receiving the threaded end of partially threaded bolt 51. Bolt 51 pivotly attaches lower clevis 65 to upper end 78 of swing suspension member 74, such as to connection loop 79 of chain 76.

From the foregoing description, it is seen that the present invention provides an extremely simple, efficient, and reliable device for attaching a swing to a cross bar. The device is easily attached to the cross bar and the bearings are easily replaced. Although a particular embodiment of the invention has been illustrated and described, various changes may be made in the form, composition, construction, and arrangement of the parts herein without sacrificing any of its advantages. Therefore, it is to be understood that all matter herein is to be interpreted as illustrative and not in any limiting sense, and it is intended to cover in the appended claims such modifications as come within the true spirit and scope of the invention.

I claim:

1. A rotating attachment device for attaching the upper end of a swing suspension member to a swing support bar having a longitudinal axis, a top, a bottom, and an outer surface; said device comprising:

an inner bearing comprising:

at least two inner bearing arc segment members; each said inner bearing arc segment member including:

an inner side including:

an inner surface adapted for engaging the outer surface of the swing support bar; and an outer side including:

a raceway including:

a radial bearing surface; and a pair of radial flanges; one said flange on each side of said radial bearing surface; said radial bearing surfaces of said first and second inner bearing members adapted to be arc segments defining an outward facing cylindrical bearing surface when said inner surfaces are engaged with the outer surface of the swing support bar; and an outer bearing comprising:

a first outer bearing member; and a second outer bearing member; each said outer bearing member including:
an inner side including:
a bearing surface adapted for bearing on said radial bearing surfaces; and
an outer side; and
a first end including:
cooperating pivot connector means pivotly connecting said first ends of said first and second outer bearing members such that said outer bearing is pivotable between an open position for fitting over said cylindrical bearing surface and a closed position wherein said inner side bearing surfaces are arc segments defining an inward facing cylindrical bearing surface for bearing on said outward facing bearing surface such that said outer bearing is rotatable 360 degrees about the swing support bar; and
a second end including a latching member for latching said outer bearing around said inner bearing in the closed position; said outer bearing including attaching means for attaching and supporting the upper end of the swing suspension member.

2. The device of claim 1 wherein:

said outer bearing members each have a width less than the distance between said radial flanges such that said radial flanges restrain axial movement of said outer bearing relative to said inner bearing.

3. The device of claim 1 wherein:

each said latching member includes:
an aperture for receiving a fastener for retaining said outer bearing in the closed position.

4. The device of claim 1 wherein:

each said latching member includes:
an aperture for receiving an attaching means for retaining said outer bearing in the closed position and for supporting a swing.

5. The device of claim 4 wherein said attaching means includes:

a shackle including:
upper clevis means including an upper clevis for pivotly attaching said shackle to said outer bearing and for retaining said outer bearing in the closed position; and
lower clevis means including a lower clevis for pivotly attaching said shackle to the upper end of the swing suspension member.

6. A rotating attachment device for attaching the upper end of a swing suspension member to a swing support bar having a longitudinal axis, a top, a bottom, and an outer surface; said device comprising:

an inner bearing comprising:
a first inner bearing member including:
an inner side including;
an inner surface adapted for engaging the outer surface of the swing support bar; and
an outer side including:
a raceway including:
a semi-cylindrical bearing surface; and
a pair of radial flanges; one said flange on each side of said raceway; and
a second inner bearing member including:
an inner side including:
an inner surface adapted for engaging the outer surface of the swing support bar; and
an outer side including:
a raceway including:
a semi-cylindrical outward facing bearing surface; and
a pair of radial flanges; one said flange on each side of said radial bearing surface; said first and second inner bearing members adapted form a sleeve around the swing support bar when said inner surfaces are engaged with the outer surface of the swing support bar such that said semi-cylindrical bearing surfaces of said first and second inner bearing members define a cylindrical bearing surface; and an outer bearing comprising:
a first outer bearing member; and
a second outer bearing member; each said outer bearing member including:
an inner side including:
a semi-cylindrical bearing surface adapted for bearing on said outward facing bearing surfaces;
an outer side;
a first end including:
cooperating pivot connector means pivotly connecting said first ends of said first and second outer bearing members such that said outer bearing is pivotable between an open position for fitting over said cylindrical bearing surface and a closed position wherein said inner side bearing surfaces defining an inward facing cylindrical bearing surface for bearing on said outward facing bearing surfaces such that said outer bearing is rotatable 360 degrees about the swing support bar; and
a second end including a latching member for latching said outer bearing around said inner bearing in the closed position; said outer bearing including attaching means for attaching and supporting the upper end of the swing suspension member.

7. The device of claim 6 wherein:

said outer bearing members each have a width less than the distance between said radial flanges such that said radial flanges restrain axial movement of said outer bearing relative to said inner bearing.

8. The device of claim 6 wherein:

each said latching member includes an aperture for receiving a fastener for retaining said outer bearing in the closed position.

9. The device of claim 6 wherein:

each said latching member includes an aperture for receiving an attaching means for retaining said outer bearing in the closed position and for supporting a swing.

10. The device of claim 9 wherein said attaching means includes:

a shackle including:
upper clevis means including an upper clevis for pivotly attaching said shackle to said outer bearing and for retaining said outer bearing in the closed position; and
lower clevis means including a lower clevis for pivotly attaching said shackle to the upper end of a swing suspension member.

11. A swing set comp rising:

a swing including:
a suspension member including:
an upper end;

a swing support bar having a longitudinal axis, a top, a bottom, and an outer surface;

a frame supporting said swing support bar in an elevated position for supporting said swing; and a rotating attachment device for attaching said upper end of said swing suspension member to said swing support bar; said device comprising:

an inner bearing comprising:

at least two inner bearing arc segment members; each said inner bearing arc segment members including:

an inner side including:

an inner surface adapted for engaging said outer surface of said swing support bar; and an outer side including:

a raceway including:

a radial bearing surface; and a pair of radial flanges; one said flange on each side of said radial bearing surface; said radial bearing surfaces of said first and second inner bearing members adapted to be arc segments defining an outward facing cylindrical bearing surface when said inner surfaces are engaged with said outer surface of said swing support bar; and an outer bearing comprising:

a first outer bearing member; and a second outer bearing member; each said outer bearing member including:

an inner side including:

a bearing surface adapted for bearing on said radial bearing surfaces;

an outer side;

a first end including:

cooperating pivot connector means pivotly connecting said first ends of said first and second outer bearing members such that said outer bearing is pivotable between an open position for fitting over said cylindrical bearing surface and a closed position wherein said inner side bearing surfaces are arc segments defining an inward facing cylindrical bearing surface for bearing on said outward facing bearing surface such that said outer bearing is rotatable 360 degrees about said swing support bar; and a second end; said second ends including a latching member for latching said outer bearing around said inner bearing in the closed position; said outer bearing including attaching means for attaching and supporting said upper end of said swing suspension member.

12. The swing set of claim 11 wherein:

said outer bearing members each have a width less than the distance between said radial flanges such that said radial flanges restrain axial movement of said outer bearing relative to said inner bearing.

13. The swing set of claim 11 wherein:

each said latching member includes an aperture for receiving a fastener for retaining said outer bearing in the closed position.

14. The swing set of claim 11 wherein:

each said latching member includes an aperture for receiving an attaching means for retaining said outer bearing in the closed position and for supporting a swing.

15. The swing set of claim 14 wherein said attaching means includes:

a shackle including:

upper clevis means including an upper clevis for pivotly attaching said shackle to said outer bearing and for retaining said outer bearing in the closed position; and lower clevis means including a lower clevis for pivotly attaching said shackle to said upper end of said swing suspension member.

16. A method of attaching an upper end of a suspension member of a swing to a swing support bar in position for supporting the swing; the swing support bar having a longitudinal axis, a top, a bottom, an outer surface, and two supported ends; said method comprising:

obtaining an inner bearing comprising: at least two inner bearing arc segment members; each inner bearing arc segment member including: an inner side including: an inner surface adapted for engaging the outer surface of the swing support bar; and an outer side including: a raceway including: a radial bearing surface; and a pair of radial flanges, one flange on each side of the radial bearing surface; the radial bearing surfaces of the first and second inner bearing members adapted to be arc segments defining an outward facing cylindrical bearing surface when the inner surfaces are engaged with the outer surface of the swing support bar;

attaching the obtained inner bearing to the support bar;

obtaining an outer bearing comprising a first outer bearing member; and a second outer bearing member; each outer bearing members including: an inner side including: a bearing surface adapted for bearing on the radial bearing surfaces; and an outer side; a first end including: cooperating pivot connector means pivotly connecting the first ends of the first and second outer bearing members such that the outer bearing is pivotable between an open position for fitting over the cylindrical bearing surface and a closed position wherein the inner side bearing surfaces are arc segments defining an inward facing cylindrical bearing surface for bearing on the outward facing bearing surface such the outer bearing is rotatable 360 degrees about the inner bearing and about the cross bar and a second end; said second ends including latching members for latching said outer bearing around said inner bearing in the closed position; and attaching means for attaching and suspending said upper end of said swing suspension member;

attaching and outer bearing to the inner bearing; and attaching the upper end of the swing suspension member to the attaching means of the outer bearing.

* * * * *

UNITED STATES PATENT AND TRADEMARK OFFICE

CERTIFICATE OF CORRECTION

PATENT NO. : 6,830,517 B1
DATED : December 14, 2004
INVENTOR(S) : Ciraolo

It is certified that error appears in the above-identified patent and that said Letters Patent is hereby corrected as shown below:

Column 6,
Line 64, "comp rising" is replace with -- comprising --;

Column 8,
Line 48, "such the outer" is replaced with -- such that the outer --; and
Line 56, "attaching and outer" is replaced with -- attaching an outer. --

Signed and Sealed this

Seventh Day of June, 2005

JON W. DUDAS
*Director of the United States Patent and Trademark Office*